United States Patent [19]

Motte et al.

[11] Patent Number: 4,997,064

[45] Date of Patent: Mar. 5, 1991

[54] DEVICE FOR AUTOMATICALLY SECURING A CLIMBER CLIMBING A WALL

[76] Inventors: Denis Motte, 10, rue sur le Quint, Baume les Dames, France, 25110; Driss Aadnan, 23, rue de la Porte de Chaux, Clerval, France, 25340

[21] Appl. No.: 497,609

[22] Filed: Mar. 22, 1990

[30] Foreign Application Priority Data

Mar. 22, 1989 [FR] France ..... 89 04028

[51] Int. Cl.[5] ..... A62B 35/00; A63B 29/00

[52] U.S. Cl. ..... 182/231; 182/19; 182/8; 182/236; 182/71

[58] Field of Search ..... 182/3, 231, 236, 8, 182/73, 71, 19

[56] References Cited

U.S. PATENT DOCUMENTS

| | | | |
|---|---|---|---|
| 3,850,263 | 11/1974 | Chin | 182/236 |
| 4,130,176 | 12/1978 | Paulie | 182/4 |
| 4,252,214 | 2/1981 | Miller | 182/8 |
| 4,436,181 | 3/1984 | Gutman | 182/231 |
| 4,449,716 | 5/1984 | Goldy et al. | 272/109 |
| 4,458,781 | 7/1984 | Ellis | 182/8 |
| 4,538,703 | 9/1985 | Ellis | 182/8 |
| 4,550,804 | 11/1985 | Bummer | 182/8 |
| 4,671,384 | 6/1987 | Sing | 182/231 |
| 4,709,783 | 12/1987 | Tomioka | 182/8 |

FOREIGN PATENT DOCUMENTS 8708902 3/1988 Fed. Rep. of Germany .

*Primary Examiner*—Reinaldo P. Machado
*Attorney, Agent, or Firm*—Bacon & Thomas

[57] ABSTRACT

This invention relates to a device for automatically securing a climber climbing a wall, wherein it comprises:

a shaft guided in rotation, at least one drum comprising a groove for receiving a line wound around the drum at least once, an irreversible control member interposed between each drum and the shaft preventing a relative rotation between the drum and the shaft in a first direction and allowing rotation of the drum in a direction opposite the first direction, a system for continuously taking-up the slack of the line, and a means for controlling rotation of the shaft in a direction opposite that allowed by the irreversible control member, enabling the climber, who has fallen, to descend.

12 Claims, 3 Drawing Sheets

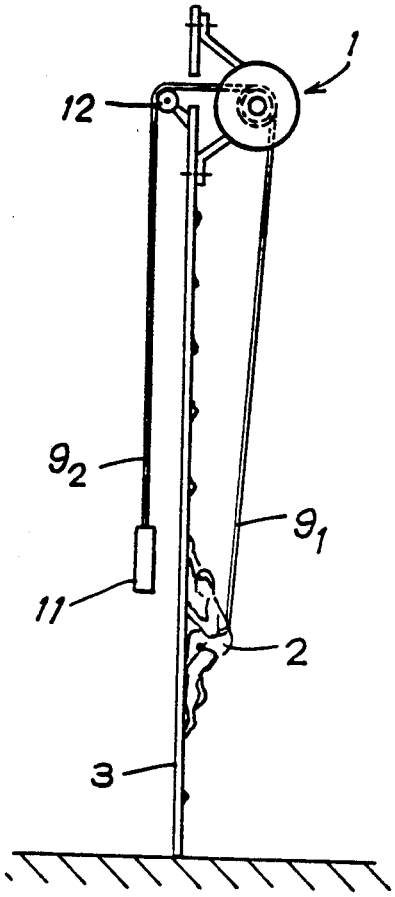
FIG. 2
FIG. 3
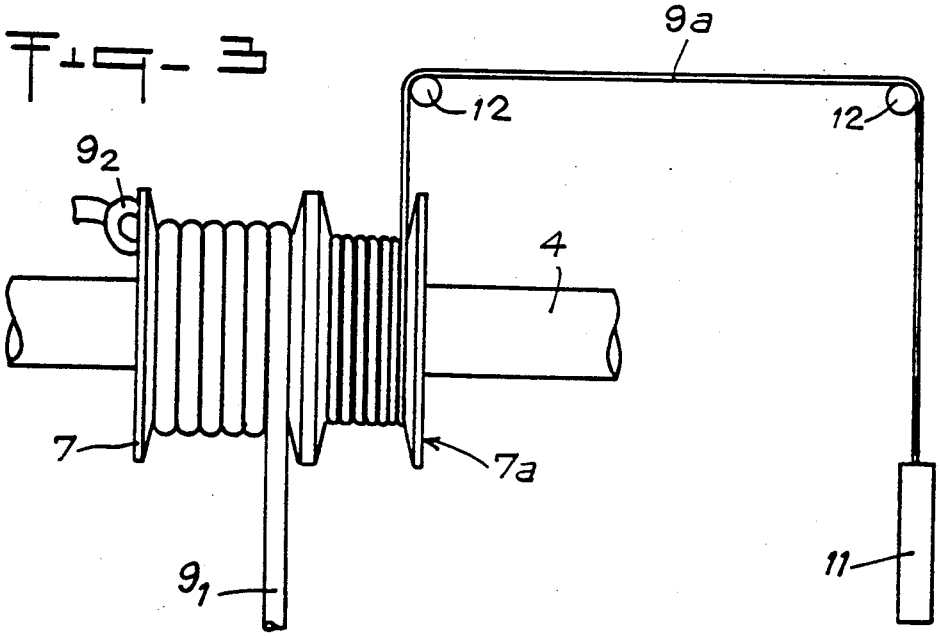

DEVICE FOR AUTOMATICALLY SECURING A CLIMBER CLIMBING A WALL

FIELD OF THE INVENTION

The present invention relates to a device for automatically securing a climber when climbing a wall.

It concerns the technical domain of climbing in the general sense and, more particularly, the means designed to secure a person climbing an artificial or natural wall.

BACKGROUND OF THE INVENTION

Natural walls are being more and more arranged or artificial walls constructed, to allow climbers to train for mountain-climbing or to practice a sporting activity or physical education.

The practice of climbing, by an increasing number of technically unqualified persons, raises a considerable problem of safety of the climbers during the climb.

In fact, the known technique for securing the climber in the event of fall consists in fixedly mounting, at the top of the wall, a bar around which passes a rope of which one end is connected to the harness worn by the climber, whilst the other end of the rope is held by a person acting as spotter for the climber.

The climber's safety therefore depends exclusively on the spotter, which constitutes a major drawback insofar as this person must be continuously vigilant and must possess manifest technical knowledge in order to perform his function of spotter completely.

It is an object of the present invention to overcome this drawback by proposing a device for automatically securing, in complete safety, one or more climbers climbing an artificial or natural wall.

Another object of the invention is to propose a device for automatically securing a climber in the event of fall whilst enabling him/her to return in complete safety to ground level.

A further object of the invention is to offer a device which, adapted to return at least one climber, who has fallen, down to ground level, continues to perform its function of securing the other climbers climbing up the wall.

Yet another object of the invention is to offer a completely reliable securing device for climber, of simple manufacture and low cost price.

SUMMARY OF THE INVENTION

To attain the above objects, the device for automatically securing a climber climbing a wall comprises:

a shaft guided in rotation by bearings adapted to be supported on the wall, at least one drum comprising a groove for receiving a line wound around the drum at least once and of which one end of the line is adapted to be connected to the climber, an irreversible control member interposed between each drum and the shaft preventing a relative rotation between the drum and the shaft in a determined direction and allowing rotation of the drum in a direction opposite the determined direction in order to allow the end of the line connected to the climber to rise, a system for continuously taking-up the slack of the line occurring as the end of the line connected to the climber rises, and a means for controlling rotation of the shaft in a direction opposite that allowed by the irreversible control member, enabling the climber, who has fallen, to descend.

BRIEF DESCRIPTION OF THE DRAWINGS

The invention will be more readily understood on reading the following description with reference to the accompanying drawings, in which:

FIG. 2 is a view in section taken substantially along line II–II of FIG. 1.

FIG. 3 is a view in elevation showing a characteristic detail of the invention.

DETAILED DESCRIPTION OF THE DRAWINGS

Figure 1:
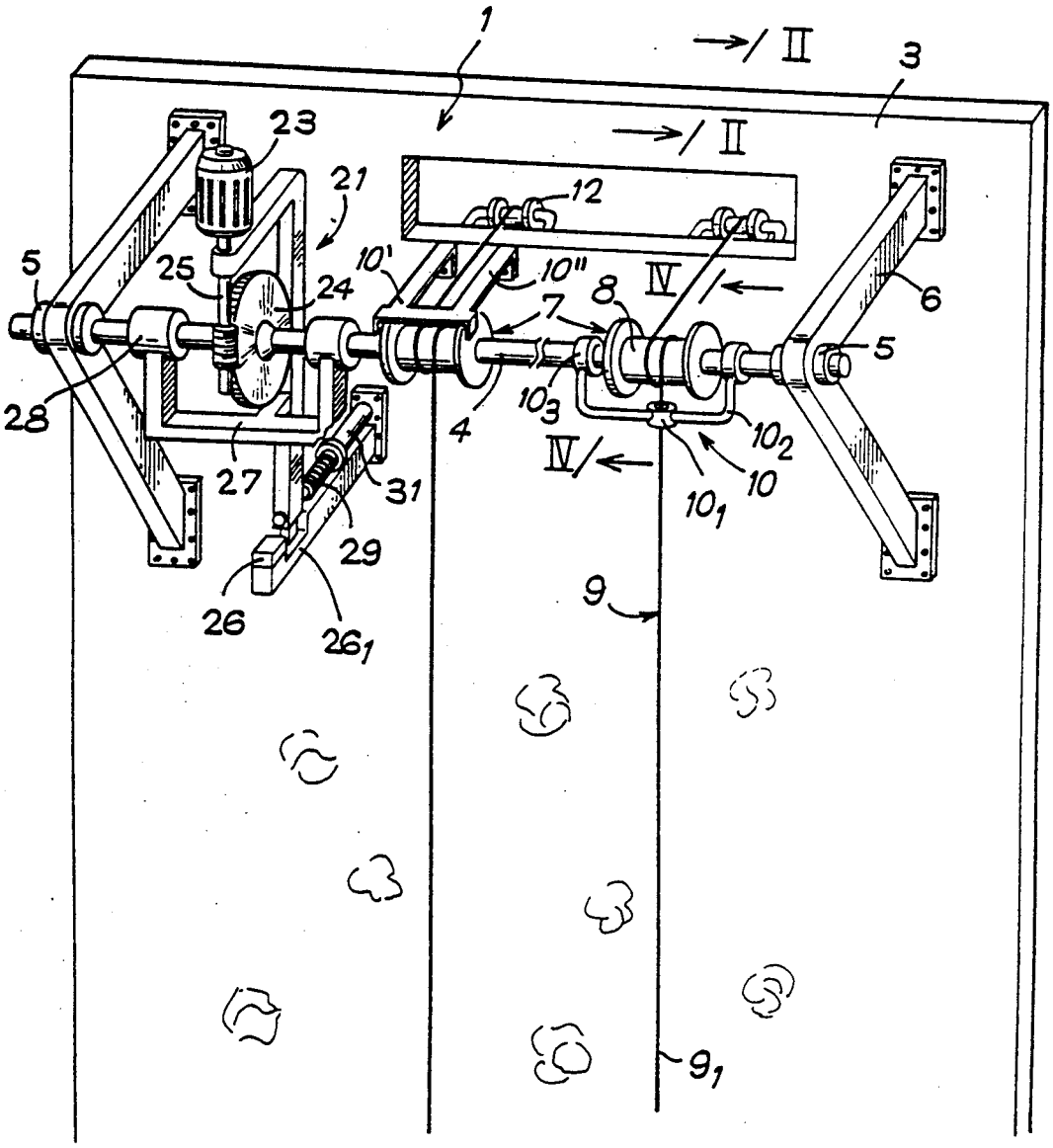
FIG. 1 ,is a perspective view showing a wall equipped with a securing device according to the invention.

Referring now to the drawings, FIGS. 1 and 2 illustrate a device 1 for automatically securing at least one climber 2 climbing a wall 3 of natural type or, as illustrated in the drawings, of artificial nature. Device 1 comprises a cylindrical shaft 4 guided in rotation, for example at each of its ends, by bearings 5 which are supported by bearing arms 6 anchored solidly at the top of the wall 3.

Shaft 4 is adapted to receive at least one and, as illustrated in FIG. 1, two drums 7 each comprising a groove 8 for receiving a rope, cord or, in general, a line 9 wound around the drum 7 at least once and, preferably, three or four times.

In order to maintain line 9 wound in the groove, each drum 7 is advantageously equipped with a holding or guiding element 10 constituted, for example, by a tubular sleeve $10_1$ through which passes line 9. Sleeve $10_1$ is supported by rods $10_2$ which are connected to rings $10_3$ mounted on shaft 4. Sleeve $10_1$ may be mounted for free axial displacement on rods $10_2$ to facilitate winding of the line on the drum.

In another embodiment illustrated in FIG. 1, the holding element 10 is formed by a bow element 10′ which is borne by fastening means 10″ anchored on wall 3, so that the bow extends near the upper part of the drum 7 in relation with groove 8.

It must be considered that the holding element 10 may also be designed to avoid any axial displacement of the line on the drum during winding thereof on the drum. To that end, the bow element 10′ may for example be in the form of a comb of which each tooth maintains and separates the line upon every turn thereof.

One end $9_1$ of the line is equipped with means, not shown but known per se, for fastening the line to a harness worn by the climber 2. The other end $9_2$ of the line cooperates with a system 11 for continuously taking up the slack of the line which occurs as the end $9_1$ rises, this occurring naturally as the climber ascends the wall.

It must be considered that the take-up system 11 may be formed by any means ensuring a continuous tension on the line. To that end, the take-up system 11 may be formed by a spring, an elastic or a motor driving in rotation, via a torque limiter, a pulley on which end $9_2$ of the line is wound. In the example illustrated in FIG. 2, the take-up system 11 is constituted by a counterweight fixed to end $9_2$ of the line.

It must be noted that the slack take-up system 11 may be adapted to act directly on drum 7 and not on end $9_2$ of the line. As shown in FIG. 3, drum 7 is mounted fast with a pulley 7a on which is fixed and wound a cable 9a of which one end cooperates with the take-up system 11. In that case, end $9_2$ of the line is fixed to drum 7.

In order to avoid the counterweight hindering the climber's ascent on the wall, line 9 is arranged to cooperate with at least one guide pulley 12 fixed either to the rear of the wall to allow the counterweight to be positioned behind the wall (FIGS. 1 and 2), or transversely with respect to the drum, so that the counterweight moves at a distance from the zone of the wall where the climber is ascending (FIG. 3). This latter embodiment is particularly suitable when the device according to the invention is used for a natural wall.

Figure 4:
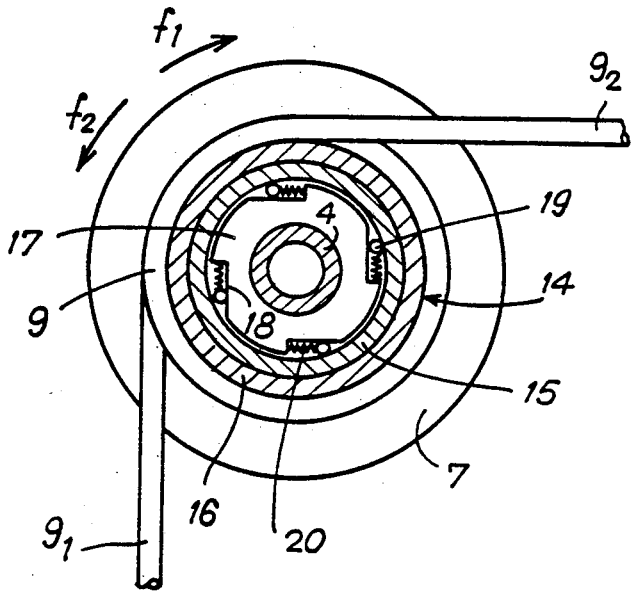
FIG. 4 is a view in section taken substantially along line IV—IV of FIG. 1 and showing another characteristic detail of the invention.

As shown more precisely in FIG. 4, each drum 7 is mounted on shaft 4 via an irreversible control member 14 formed for example by a ratchet wheel or, as illustrated in the drawing, by a free wheel. Control member 14 on the one hand allows a rotation of drum 7 in a determined direction represented by arrow $f_1$, allowing the line to wind in a direction ensuring rise of end $9_1$ connected to the climber. On the other hand, the control member prohibits relative rotation between drum 7 and shaft 4 in a direction $f_2$ opposite direction $f_1$.

Such a control member 14 comprises, in conventional manner, an outer ring 15 mounted fast with hub 16 of the drum and an inner ring 17 fixed in rotation on shaft 4. Rings 15 and 17 are associated by an irreversible wedging assembly constituted by wedging ramps 18 which are borne by the outer surface of ring 17 to act on rollers, cylinders or, as illustrated, balls 19 each urged into engagement by a spring 20. Rotation of drum 7 in direction $f_1$ causes rotation of the outer ring 15 which is angularly free in that direction, insofar as balls 19 are displaced against springs 20. The application of an effort on the line, caused in particular by a climber falling, produces an angular displacement of drum 7 in direction $f_2$, making it possible to obtain an angular connection between rings 15 and 17, since balls 19 are urged into wedged state. Relative rotation between drum 7 and shaft 4 in direction $f_2$ is therefore prohibited.

As is more precisely shown in FIG. 1, the securing device comprises a means 21 for controlling rotation of the shaft 4 in direction $f_2$, so as to control the angular displacement of drum 7 in that sense. Means 21 makes it possible to obtain controlled unwinding of end $9_1$ of the line in direction $f_2$, allowing the climber, who has fallen, to descend down to ground level. Control means 21 is constituted for example by a drive member 23 driving in rotation a wheel 24 mounted fast with shaft 5 (FIG. 1). Wheel 24 preferably constitutes a pinion cooperating with a threaded rod 25 coupled to the driven shaft of the drive member 23.

Drive member 23 is controlled in rotation as soon as a climber climbs the wall or when a sensor 26 detects determined efforts exerted on the drum and corresponding to those applied on the line by the climber having fallen.

In the variant embodiment illustrated in FIG. 1, the sensor 26, which is borne by a bar $26_1$ anchored on wall 3, detects the pivoting of a structure 27 bearing the drive member 23 and the threaded rod 25. This bearing structure 27, which is pivotally mounted with the aid of bearings 28 fitted on shaft 4, is urged in elastic return by a spring 29 borne by a rod 31 fixed on the wall. Spring 29 additionally performs a function of shock-absorption in the event of a climber falling.

Pivoting of the bearing structure 27 is obtained in the event of the climber falling, the latter, by his/her weight, exerting efforts on the line, generating a force couple on the wheel 24 via shaft 4 and drum 7. This force couple applied to wheel 24 produces an axial displacement of the threaded rod 25 which provokes pivoting of the bearing structure 27.

The device according to the invention described hereinabove automatically secures, in complete safety and individually, each climber climbing wall 3, without hindering the climbers' ascent. In fact, when the climber climbs the wall, the line presents a slack which is immediately taken up by counterweight 11 driving drum 7 in rotation in direction $f_1$, thanks to the adherence of the line on the drum.

In the event of a fall, the climber exerts, by his/her weight, efforts on the line which bring about an angular connection between shaft 4 and drum 7 as explained hereinabove. The efforts exerted on the line generate a couple which produces pivoting of bearing structure 27. Such pivoting is detected by sensor 26 which controls drive member 23 in rotation, driving, in direction $f_2$, shaft 4 and drum 7. Controlled rotation of shaft 4, preferably at constant speed, results in line 9 unwinding, ensuring in complete safety descent of the climber, having fallen, down to the ground.

During the descending phase of the or each climber having fallen, the device according to the invention continues to secure the other climbers climbing the wall and to perform its function of taking up the slack of the lines 9 connected to each climber climbing the wall.

Figure 5:
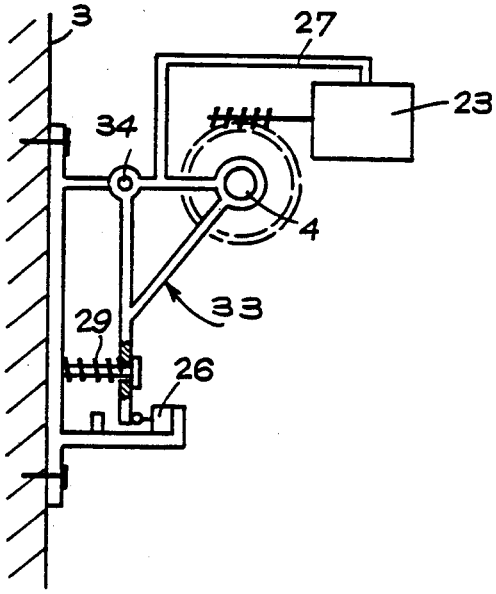
FIGS. 5 and 6 are sections in elevation showing another embodiment of the device according to the invention.
Figure 6:
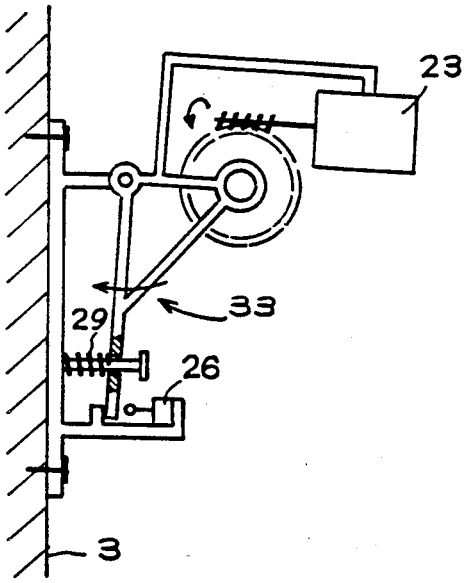

FIGS. 5 and 6 illustrate a variant embodiment in which the means 21 for controlling rotation of shaft 4 is controlled when sensor 26 detects pivoting of shaft 4 which constitutes, with structure 27 bearing drive member 23, a mounting 33 articulated on a pin 34 with respect to wall 3 and urged by a return spring 29. Pivoting of shaft 4 is provoked as described hereinabove by the efforts exerted on the line by the climber having fallen.

Figure 7:
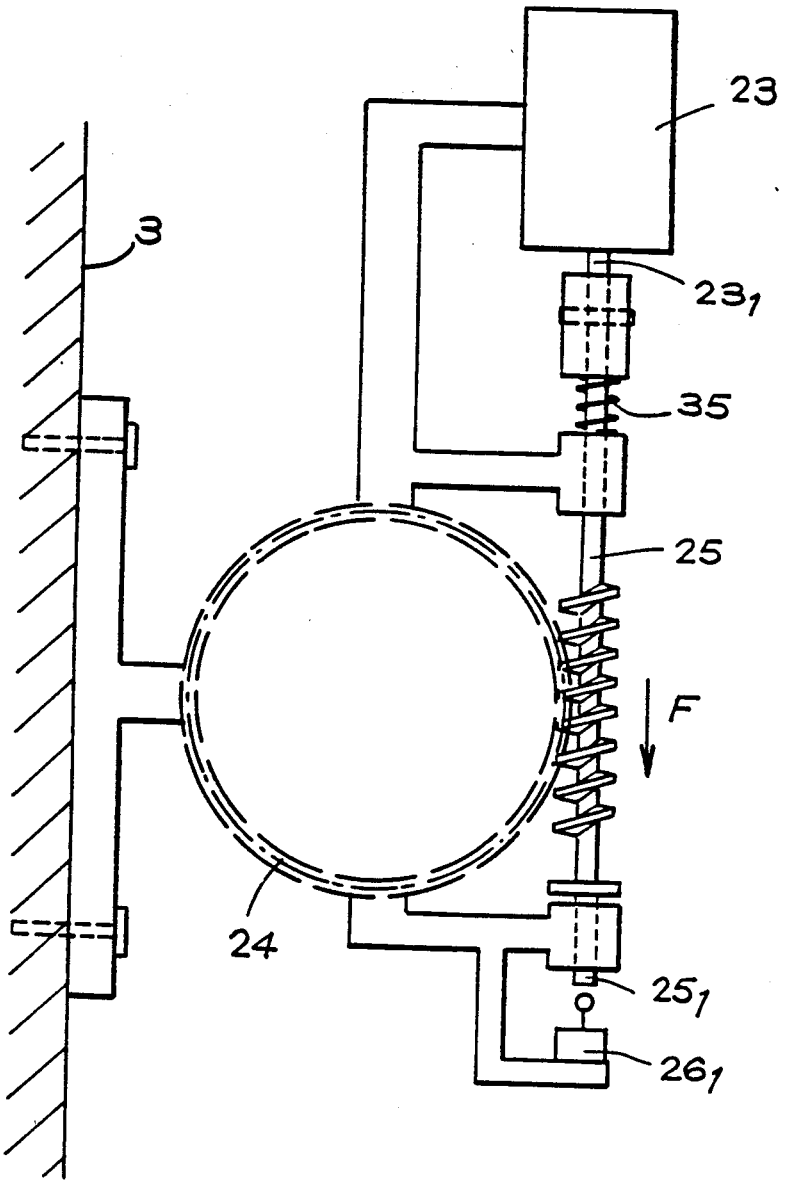
FIG. 7 is a view in elevation of another variant embodiment of the device according to the invention.

FIG. 7 illustrates another variant embodiment of the detection of a climber falling. According to this variant, the threaded rod 25 is angularly fixed on the driven shaft $23_1$ of the drive member 23 and presents a freedom of axial displacement with respect to the drive member. The threaded rod 25 is urged by a return spring 35.

When a force couple appears on wheel 24, due to the fall of at least one climber, wheel 24 exerts an axial thrust F on the threaded rod 25 which is displaced in order to cooperate with a sensor $26_1$ placed in relation with the free terminal part $25_1$ of the rod. Such a sensor may be of the pressure type or be constituted by an electrical contact controlling rotation of drive member 23.

The invention is not limited to the embodiments described and shown, as various modifications may be made without departing from the scope thereof.

What is claimed is:

1. A device for automatically securing a climber climbing a wall, wherein it comprises:

a shaft guided in rotation by bearings adapted to be supported by the wall, at least one drum comprising a groove for receiving a line wound around the drum at least once and of which one end of the line is adapted to be connected to the climber, an irreversible control member interposed between each drum and the shaft preventing a relative rotation between the drum and the shaft in a determined direction and allowing rotation of the drum in a direction opposite the determined direction in order to allow the end of the line connected to the climber to rise, a system for continuously taking-up the slack of the line occurring as the end of the line connected to the climber rises, and a means for controlling rotation of the shaft in a direction opposite that allowed by the irreversible control member, enabling the climber, who has fallen, to descend.

2. The device of claim 1, wherein the means for controlling rotation of the shaft is controlled upon detection, by a sensor, of determined efforts exerted on the drum and corresponding to those applied to the line by a climber having fallen.

3. The device of claim 1, wherein the means for controlling rotation of the shaft is constituted by a drive member mounted on a bearing structure and controlling in rotation a wheel fixed on the shaft.

4. The device of claim 3, wherein the wheel constitutes a pinion cooperating with a threaded rod fast with the drive member.

5. The device of claim 4, wherein the wheel ensures, upon application on the shaft of efforts corresponding to a climber falling, the axial displacement of the threaded rod which is urged in elastic return, actuating a sensor of pressure or of displacement mounted in relation with the free terminal part of the threaded rod.

6. The device of claim 4, wherein the wheel ensures, upon application on the shaft of efforts corresponding to a climber falling, the pivoting of the bearing structure urged in elastic return and whose pivoting is detected by the sensor.

7. The device of claim 1, wherein the guiding bearings of the shaft and the bearing structure constitute an elastically returned mounting, articulated with respect to the wall and whose pivoting is detected by the sensor.

8. The device of claim 1, wherein the system for taking up the slack of the line is constituted by a counterweight retained by a cable wound on the drum.

9. The device of claim 1, wherein the system for taking up the slack of the line is formed by a drive and couple limiter unit acting on a cable wound on the drum.

10. The device of claim 8, wherein the cable is constituted by the end of the line opposite the one connected to the climber.

11. The device of claim 1, wherein each drum comprises an element for guiding and holding the line in position of winding in the groove of the drum.

12. The device of claim 9, wherein the cable is constituted by the end of the line opposite the one connected to the climber.

* * * * *